US005401236A

United States Patent [19]

Summerville

[11] Patent Number: 5,401,236

[45] Date of Patent: Mar. 28, 1995

[54] ORTHOPEDIC TRACTION APPARATUS

[76] Inventor: Vernon R. Summerville, 1706 Veterans Dr., Lot 311, Scottsboro, Ala. 35768

[21] Appl. No.: 208,565

[22] Filed: Mar. 10, 1994

[51] Int. Cl.[6] ..... A61H 1/02

[52] U.S. Cl. ..... 602/33; 602/34; 606/241

[58] Field of Search ..... 606/237, 240, 241, 242, 606/243, 244; 242/107.2; 254/269

[56] References Cited

U.S. PATENT DOCUMENTS 1,023,816 4/1912 Coggeshall ..... 242/107.2
2,821,978 2/1958 Lindstrom ..... 602/33
2,907,324 10/1959 Catanzaro ..... 602/34 X
4,674,485 6/1987 Swanson ..... 602/33
4,865,022 9/1989 Gorsen ..... 602/33

FOREIGN PATENT DOCUMENTS 2290184 9/1976 France ..... 602/33

*Primary Examiner*—Peter A. Aschenbrenner
*Attorney, Agent, or Firm*—John C. Garvin, Jr.

[57] ABSTRACT

An orthopedic traction apparatus for use with an adjustable hospital bed and capable of being operated by a patient within the bed to independently get in and out of the traction apparatus without the help of another person.

10 Claims, 2 Drawing Sheets

ORTHOPEDIC TRACTION APPARATUS

FIELD OF THE INVENTION

The present invention relates to an orthopedic traction apparatus and more particularly to an improved orthopedic traction apparatus for use with an adjustable hospital bed and capable of use by a patient to independently get in and out of the traction apparatus without the help of another person such as a nurse or a physical therapist.

BACKGROUND OF THE INVENTION

It is known to provide overhead support framing for hospital beds to assist in the treatment and movement of patients. Such framing is variously constructed and generally includes vertical, upright, support members suitably attached to the head and foot of the bed and interconnected by a horizontal member which extends the length of the bed in spaced relation above the mattress and the patient at a height to support various orthopedic equipment such as a hand trapeze, pulleys, weights and an interconnecting support line or cable.

It is also known to specifically provide an orthopedic traction apparatus for use with conventional, adjustable, hospital beds in which portions of the bed move to angularly position portions of the mattress and its supporting frame relative to other portions of the mattress and its supporting frame.

The conventional apparatuses for applying traction to a patient normally require the attendance of a suitably trained person such as a nurse, a nurse's aide or a physical therapist to apply and release the traction apparatus to and from the patient; thus the patient must be hospitalized on either an in-patient or out-patient basis to receive treatment which is extremely costly.

In view of the relatively high costs associated with conventional orthopedic traction apparatuses which require an attendant to apply and release traction to a patient, there is a need for a durable and inexpensive traction apparatus which permits the patient to easily get in and out of the traction without the help or assistance of another person such as a nurse, nurse aide, or a physical therapist.

Accordingly, it is an object of the present invention to provide a simple, inexpensive, and reliable traction apparatus which can be used in a conventional hospital bed either at home or in a hospital which does not require an attendant to apply or release traction to a patient.

A further object of the present invention is to provide a traction apparatus for use with conventional overhead framings and hospital beds which is adapted for independent operation by the patient to apply traction to and release traction from the patient.

These objects as well as other objects of the present invention will become more readily apparent from the following description taken in conjunction with the accompanying drawings.

DETAILED DESCRIPTION OF PREFERRED EMBODIMENT OF THE INVENTION

Figure 1:
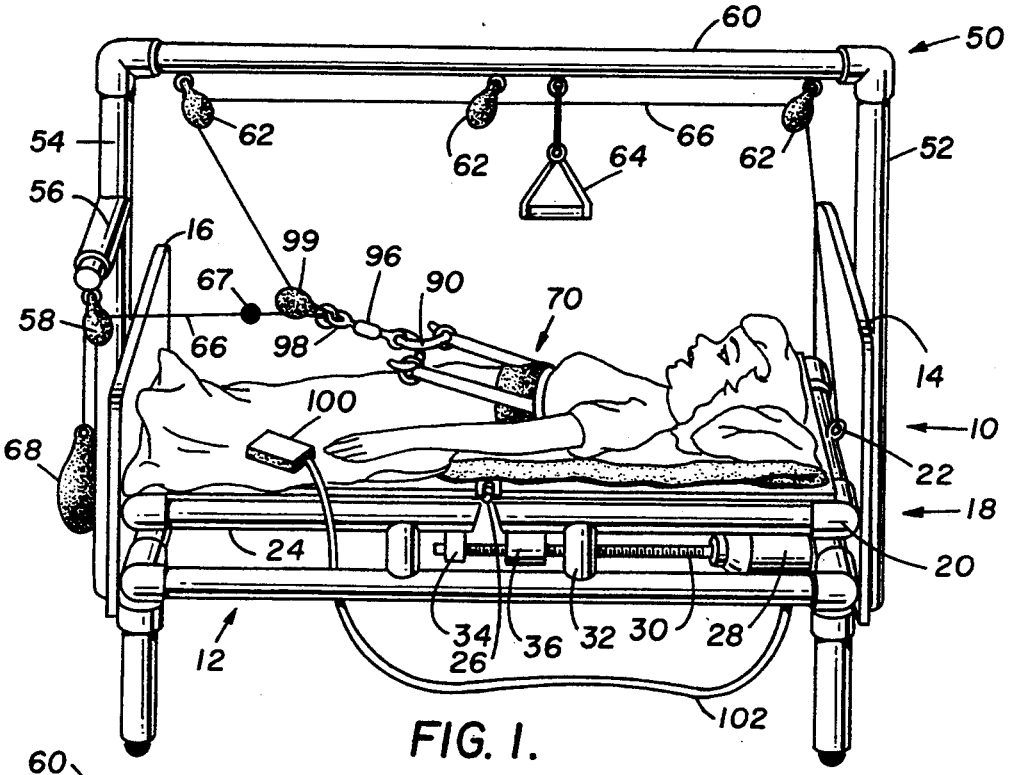
FIG. 1 is a perspective, side elevational, view of a patient lying in the prone position in a hospital bed to which the traction device of the present invention is connected for applying traction to the patient.
Figure 3:
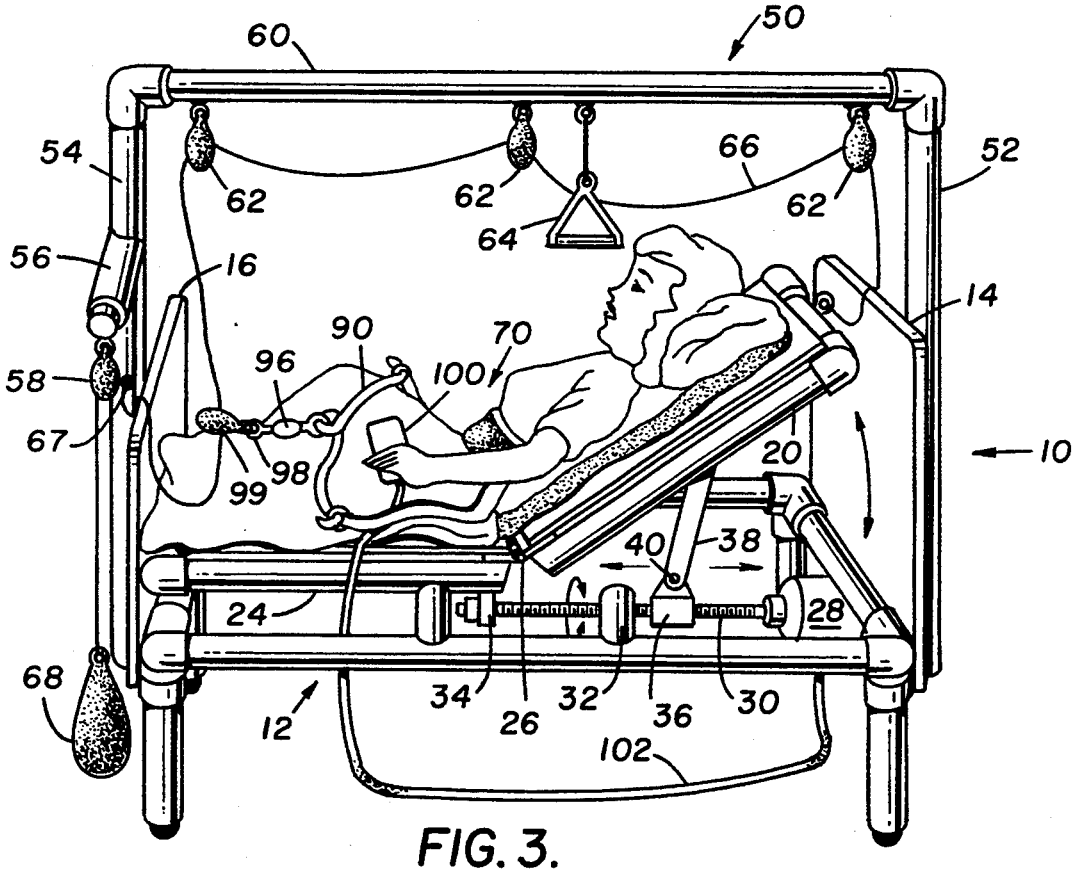
FIG. 3 is a perspective, side elevational, view of a patient positioned in the raised condition of a hospital bed which allows the patient to independently release herself/himself from the traction device of the present invention.

FIG. 1 illustrates, by way of example, the preferred embodiment of the invention with traction being applied to the pelvic area of a patient. FIG. 3, illustrates, by way of example, the preferred embodiment of the invention without traction being applied to a patient. Referring now to FIGS. 1 and 3, reference numeral 10 refers to a conventional hospital bed including a frame 12, a vertical head board 14, a vertical footboard 16, and mattress support springs 18. Mattress support springs 18 includes a head section 20 and a foot section 24 connected by one or more hinges 26, with head section 20 including an eyelet 22. Frame 12 of bed 10 supports a conventional electric motor 28 having an elongated externally threaded drive, screw 28 and first and second support members 32. A first bearing 34 is secured to foot section 24 of mattress support springs 18 and to the free end (unnumbered) of drive screw 30. An internally threaded traveling nut 36 is threadly engaged with the external threads of drive screw 30 and is connected by a pen 40 to linkage 38 (FIG. 3) which is pivotally secured to head section 38 such that when electric motor 28 is energized to rotate drive screw 30 to longitudinally move the traveling nut 36 along drive screw 30, the head section 20 of mattress support springs 18 moves about hinges 26 relative to foot section 24 of mattress support springs 18 to raise or lower head section 20.

Also as best seen in FIGS. 1 and 3, the orthopedic traction frame 50 includes a first upstanding frame member 52 secured by any conventional means (such as welds or nuts and bolts) to vertical head board 14 of bed frame 12, a second upstanding frame member 54 secured by any conventional means (such as welds or nuts and bolts) to vertical foot board 16 of bed frame 12, and a horizontal support member 60 secured by any suitable means to and connecting the first and second upstanding frame members 52 and 54. Second upstanding frame member 54 includes a horizontal extending support element 56 secured thereto which has a pulley 58 secured to the free end (unnumbered) of pulley support element 56. Horizontal support member 60 has a plurality of drop pulleys 62 and a trapeze swing 64 suspended therefrom.

Figure 2:
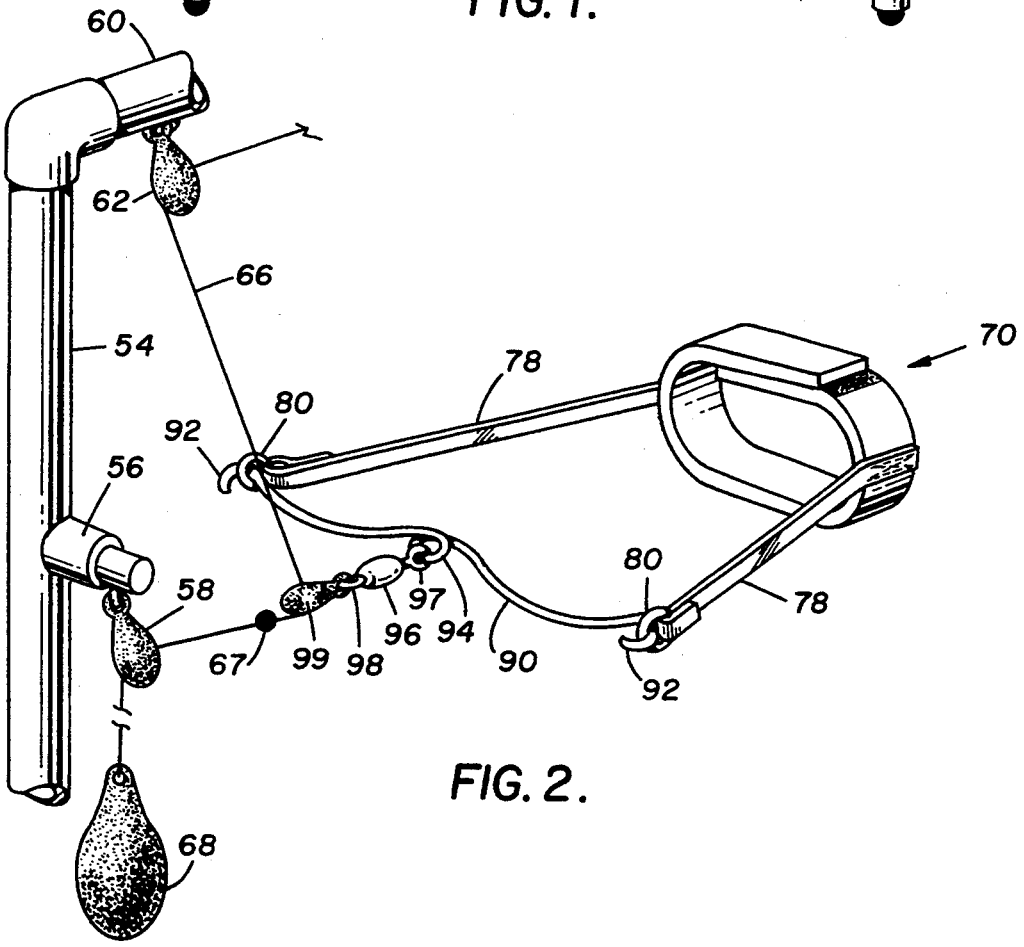
FIG. 2 is a perspective view which schematically illustrates the traction device of the present invention (without the bed and patient) in the condition where it would be applying traction to the back of a patient.
Figure 4:
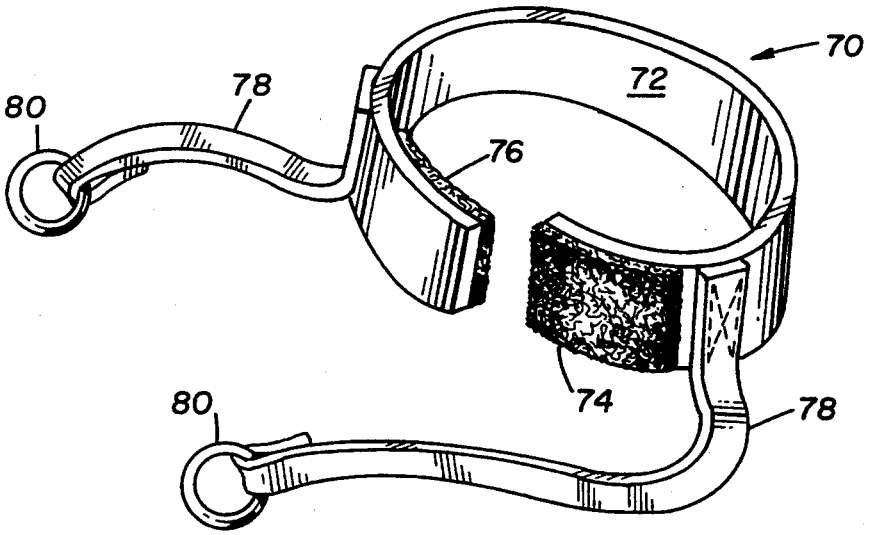
FIG. 4 is a perspective view of a pelvic belt which forms a part of the traction device of the present invention.

As best seen in FIG. 2, reference numeral 70 designates a pelvic belt for strapping around the pelvic area of a patient. Pelvic belt 70 comprises a broad strip of fabric having first and second VELCRO fasteners 74 and 76 (FIG. 4), respectively, secured to its free ends and a pair of flexible straps 78 secured to an intermediate section. Each flexible strap 78 has a ring 80 secured to its free ends.

As also best seen in FIG. 2, reference numeral 90 designates a yoke element. Yoke element 90 is preferably made from a metal bar and includes a pair of hooks 92 at its ends, an eyelet 94 in an intermediate section, a swivel element 96 having a first eyelet 97 secured to eyelet 94 of yoke element 90, a second eyelet 98, and a pulley 99 connected to second eyelet 98.

As best seen in FIGS. 1 and 3, one end of a cable or filament 66 is secured to, the eyelet 22 of head section 20 of mattress support spring 18 and passes through each of the drop pulleys 62 suspended from elongated horizontal member 60 of orthopedic traction frame 50, pulley 99 of swivel 96, and pulley 58 suspended from horizontal support element 56. The other end of cable or filament 66 has one or more weights 68 secured thereto for applying tension to cable or filament 66 and pelvic belt 70. A stop ball 67 is secured to cable 66 for restricting or limiting the movement of cable 66 in the area between pulleys 58 and 99.

A conventional console 100 (having appropriate buttons or switches) is connected via electrical cable 102 to motor 28 for energizing motor 28 to rotate drive screw 30 to raise and lower head section 20 of mattress support springs 18.

In operation, a patient, lying in the prone position as illustrated in FIG. 1, will activate the appropriate button or switch on console 100 to raise head section 20 of mattress support springs 18 to the position generally shown in FIG. 3, at which time there is slack in filament or cable 66; the patient will then fasten pelvic belt 70 around her/his pelvic area by engaging the VELCRO strips 74 and 76, engaging the hooks 92 of yoke element 90 within the rings 80 of pelvic belt 70; and then actuating the appropriate button or switch of console 100 to lower the head section 20 of mattress support springs 18 to the position as generally shown in FIG. 1 which allows the weight(s) 68 to tighten the filament or cable 66 and apply traction or tension to the pelvic area of the patient.

After the patient has applied traction for the prescribed time, the patient merely actuates the appropriate button or switch of the console 10 to raise the head section 20 of mattress support springs 18 from the position illustrated in FIG. 1 to the position illustrated in FIG. 3 which removes the tension from the filament or cable 66, thus allowing the patient to easily, readily, and independently disengage the rings 80 of pelvic belt 70 from the hooks 92 of yoke element 90 and the VELCRO strips 74 and 76 to remove the pelvic belt 70 from the patient.

While the above description constitutes a preferred embodiment of the present invention, it will be appreciated that the invention is susceptible to modification, variation and change without departing from the proper scope and fair meaning of the accompanying claims. For example, the apparatus of the present invention can be readily modified to apply traction to other parts of a human body other than the pelvic area and back. It is further apparent that it is not necessary that the traction frame be physically attached to the bed.

I claim:

1. An orthopedic traction apparatus for application or release of tractive forces to a selective body portion of a patient including a hospital bed having a head section, a foot section, and means for raising and lowering said head section relative to said foot section, said apparatus comprising:

a support structure;

guide means carried by said support structure;

means releasably securable to said selective body portion of the patient by the patient within said hospital bed;

load applying means; and an elongated filament having a first end section, an intermediate section, and a second end section, said first end section being secured to said head section of said hospital bed, said intermediate section being in communication with said guide means and said releasably securable means, and said second end section being secured to said load applying means, said elongated filament being responsive to the actuation of said means for raising and lowering said head section of said hospital bed by the patient within said hospital bed for applying and removing tension to and from said elongated filament to allow the patient to independently secure and release said releasably securable means to and from said selective body portion of the patient to selectively apply said tractive forces to or release said tractive forces from said selective body portion of the patient.

2. The apparatus according to claim 1 wherein said releasably securable means includes a belt having means for releasably fastening same about said selective body portion of the patient and at least two straps, each strap having one end secured to said belt and a free end having connector devices secured thereto.

3. The apparatus according to claim 2 wherein said releasably securable means further includes a yoke element having a pair of end sections and an intermediate section, each said end section having a fastener for being releasably secured to a respective said connector device of said straps of said belt, and said intermediate section being in communication with said intermediate section of said elongated filament.

4. The apparatus according to claim 3 further comprising means secured to said intermediate section of said elongated filament for restricting movement of said elongated filament.

5. The apparatus according to claim 4 wherein said movement restricting means comprises a ball secured to said intermediate section of said elongated filament.

6. The apparatus of claim 5 wherein said belt selectively applies tractive forces to the pelvic area of the patient.

7. In an orthopedic traction apparatus for application or release of tractive forces to the pelvic area of a patient including an adjustable hospital bed having a vertical head board, a vertical foot board, a frame secured to and connecting said head board and said foot board, mattress support means having a head section and foot section, said head section of said mattress support means having filament securing means, and means for raising and lowering said head section of said mattress support means relative to said foot section of said mattress support means, said apparatus comprising:

a traction frame including a first vertically disposed frame member secured to said head board, a second vertically disposed frame member secured to said foot board, and a horizontally disposed support member secured to and connecting said first and second vertically disposed frame members;

a belt for applying said tractive forces to the patient within said hospital bed, said belt including means for securing same about said pelvic area of the patient and a plurality of straps, each strap being secured at one end to said belt and having connector means secured to the free end thereof;

guide means secured to said traction frame;

load applying means;

an elongated filament having one end secured to said filament securing means on said head section of said mattress support means and its other end secured to said load applying means; and means for releasably connecting said connector means of said straps to said elongated filament for allowing the said tractive forces to be applied by said elongated filament and said load applying means, said elongated filament being responsive to the actuation of said means for raising and lowering said head section of said mattress support means by the patient within said hospital bed for applying and removing said tractive forces to and from said elongated filament to allow the patient to independently secure said releasably connecting means from said belt to selectively apply said tractive forces to and from the patient.

8. The apparatus according to claim 7 wherein said releaseably securable means includes a yoke element having a pair of end sections and an intermediate section, each said end section having a fastener for being releaseably secured to a respective said connector means of each said strap of said belt, and said intermediate section being in communication with said elongated filament.

9. The apparatus according to claim 8 further comprising means secured to said elongated filament for restricting movement of said elongated filament.

10. The apparatus according to claim 9 wherein said movement restricting means comprises a ball secured to said elongated filament.

* * * * *